US005893256A

United States Patent [19]

Ghirlandi

[11] Patent Number: 5,893,256

[45] Date of Patent: Apr. 13, 1999

[54] PACKAGING APPARATUS

[75] Inventor: Dante Ghirlandi, Luxembourg, Luxembourg

[73] Assignee: Luxteco International S.A., Luxembourg, Luxembourg

[21] Appl. No.: 08/970,798

[22] Filed: Nov. 14, 1997

[30] Foreign Application Priority Data

Nov. 15, 1996 [IT] Italy ..... BO96A0583

[51] Int. Cl.[6] ..... B65B 29/04

[52] U.S. Cl. ..... 53/134.2

[58] Field of Search ..... 53/413, 134.2; 206/0.5; 426/83, 435

[56] References Cited

U.S. PATENT DOCUMENTS

| | | | |
|---|---|---|---|
| 3,191,355 | 6/1965 | Morpurgo | 53/134.2 |
| 4,055,668 | 10/1977 | Kopp | 206/0.5 X |
| 4,828,851 | 5/1989 | Romagnoli | 206/0.5 X |
| 4,829,742 | 5/1989 | Romagnoli | 53/134.2 |
| 4,853,071 | 8/1989 | Romagnoli | 53/134.2 |
| 4,856,257 | 8/1989 | Romagnoli | 53/134.2 |
| 4,885,896 | 12/1989 | Romagnoli | 53/134.2 X |
| 4,961,301 | 10/1990 | Bonomelli | 53/134.2 X |
| 4,977,728 | 12/1990 | Rambold | 53/134.2 X |
| 5,135,762 | 8/1992 | Vernon et al. | 53/134.2 X |
| 5,358,724 | 10/1994 | Raffaele | 53/134.2 X |
| 5,366,741 | 11/1994 | Van Der Zon | 206/0.5 X |
| 5,399,224 | 3/1995 | Vernon et al. | 53/134.2 X |
| 5,511,359 | 4/1996 | Kenney | 53/134.2 X |
| 5,527,419 | 6/1996 | Vernon et al. | 53/134.2 X |
| 5,552,164 | 9/1996 | Kuipers et al. | 53/134.2 X |
| 5,552,165 | 9/1996 | Haak et al. | 53/134.2 X |
| 5,632,132 | 5/1997 | Kuipers et al. | 53/134.2 X |
| 5,674,544 | 10/1997 | Shakspeare | 426/83 X |

FOREIGN PATENT DOCUMENTS

| | | |
|---|---|---|
| 489554A1 | 6/1992 | European Pat. Off. . |
| 1001944 | 1/1957 | Germany . |
| 3807763A1 | 3/1988 | Germany . |
| 94/22721 | 10/1994 | WIPO . |
| 95/10461 | 4/1995 | WIPO . |
| 95/10462 | 4/1995 | WIPO . |
| 95/27666 | 10/1995 | WIPO . |
| 96/15033 | 5/1996 | WIPO . |
| 96/31395 | 10/1996 | WIPO . |
| 97/19005 | 5/1997 | WIPO . |

*Primary Examiner*—Daniel B. Moon
*Attorney, Agent, or Firm*—Pillsbury Madison & Sutro LLP

[57] ABSTRACT

A packaging apparatus for making two-lobed tea bags with squeeze feature envisages a consecutive series of stations located along a feed line and used to make a continuous tube of heat-sealable filter paper with a longitudinal center line and including individual pouches containing charges of product; each pouch is delimited by a front and rear area closed off from the other pouches by a crossways seal. At one of the stations, a heat-sealable thread is made to follow a path, forming a coil, on the free surface of the pouches and is sealed to the latter, with the ends of the thread placed on corresponding front areas of each pouch on opposite sides of the center line. The next station cuts the continuous tube and the thread crossways in such a way as to form a tea bag consisting of a pair of pouches. At the last station, the pouches are folded over and sealed to each other at their free ends where a tag used for picking up the tea bag is then applied.

11 Claims, 4 Drawing Sheets

43b
27b
43a
18b
18
18a
16
16s
16r
16c
18c
26a
26b
26
26c
61a
60
61b
47
19
28a
28b
4s
46
28c
28e
62
48
30
49
33s
Y
F1
20
21b
7t
25
24
15

PACKAGING APPARATUS

BACKGROUND OF THE INVENTION

The present invention relates to a packaging apparatus and, in particular, an apparatus for making filter paper bags containing infusable products such as tea, coffee or chamomile.

The use of filter paper bags, referred to more simply as tea bags, for making infusions has become widespread throughout the world because they are so handy and easy to use.

The increasing world-wide popularity of tea bags has led distributors of tea and other infusable products to invest huge resources into research targeted to improving tea bag design and ease of use.

This research has aimed to improve tea bag forms, the ease with which the product is released into the liquid during infusion, shelf life, ease of packaging the tea bags into their final containers and so on.

Over the years, the original single-lobed tea bag, with pick-up thread and tag has been replaced by the now well-established two-lobed tea bag (still with pick-up thread and tag and with or without individual overwrap). The two-lobed tea bag is made from a piece of tubular filter paper filled with two charges of infusable product each in a separate pouch. The two pouches are then folded over each other so that there is a larger surface area in contact with the liquid thus allowing the two charges of product inside the pouches to infuse more effectively.

A more recent market development has been the possibility of making tea bags which, after infusion, that is to say, at the moment they are removed from the liquid, can be squeezed in order to wring as much liquid as possible from the bag and also to prevent the liquid from dripping while the bag is being disposed of.

This squeeze feature allows the user to make the most of that part of the infusion (usually containing a high concentration of product) which is normally lost when the tea bag is removed from the pot and thrown away. The squeezing action is achieved by pulling the thread which typically attaches the tea bag to the tag. At present, the squeeze feature is applied to single-lobed tea bags, as disclosed, for example, by international patent publications N. WO-94/22721, or N-WO-95/10461 and WO-95/10462 or N. WO-96/15033 and WO-95/27666.

Attempts have recently been made to apply the squeeze feature to the two-lobed, and more widely-used, tea bags as well.

To obtain two-lobed tea bags of this kind, it is necessary to provide tea bags with squeezing means that are practical and reliable for users and, at the same time, economical enough not to raise the unit cost of each tea bag.

In this regard, we refer to the two-lobed tea bag described in patent application N. WO-97/19005 where, between the two pouches which contain the product charges and whose opposite ends are joined to each other, there is a thread by which the tea bag can be held during infusion and which is attached to a first area at the bottom end of the bag and not forming part of the product pouches. The thread extends to a second area at the top end of the tea bag and again in the space between the two folded pouches.

The thread is looped in such a way that it forms a coil between the two pouches that does not protrude from the sides of the tea bag itself. The thread loop is attached to the said end areas. The thread is also attached to a tag which allows the user to pull it and thus squeeze the tea bag.

The squeezing action is enhanced by the fact that between the pouches the coil forms a cross which makes it easier to draw the opposite corners of the tea bag together.

SUMMARY OF THE INVENTION

The present invention has for an object to provide an apparatus capable of making two-lobed tea bags, with squeeze feature, rapidly and economically and of forming all the parts of the tea-bags with a high degree of precision.

BRIEF DESCRIPTION OF THE DRAWINGS

The technical characteristics of the invention according to the above mentioned aim are described in the claims below and the advantages of the invention will become more apparent from the detailed description which follows, with reference to the accompanying drawings, which illustrate a preferred embodiment of the invention and in which:

DESCRIPTION OF THE PREFERRED EMBODIMENTS

As shown in the accompanying drawings, with particular reference to FIGS. 1 to 5, the apparatus disclosed by the present invention makes two-lobed tea bags with squeeze feature. These tea bags consist essentially of two pouches 1 and 2, each containing a charge 5 of infusable product (for example, tea, coffee or chamomile) and made from a piece of tubular, heat-sealable filter paper.

These two pouches 1 and 2 are attached to each other at their corresponding, near ends 1*a* and 2*a* and folded over so as to join the free, opposite ends 1*b* and 2*b* and so that the pouches come face to face on their inner sides. A thread 3 is attached between these facing surfaces to permit the tea bag to be picked up during infusion.

The pick-up thread 3 is wound in a coil S between the two pouches 1 and 2 whose width is prevented from exceeding the width of the tea bag by retaining points (described in more detail below) at end areas of the pouches 1 and 2 and reaching as far as the top ends.

In the latter area (that is, at the top ends), the thread 3 is also attached to a tag 4 and both the thread and the tag are attached to the tea bag by a strip of filter paper forming part of the bag itself. The tag 4 is made in such a way that, once detached from the tea bag, it can be used not only in the usual manner, that is, to manipulate the bag during infusion, but also to permit the thread 3 to be pulled in order to squeeze the tea bag. In other words, pulling the thread 3 draws the ends of the pouches 1 and 2 together and thus squeezes liquid out of the tea bag.

Figure 6:
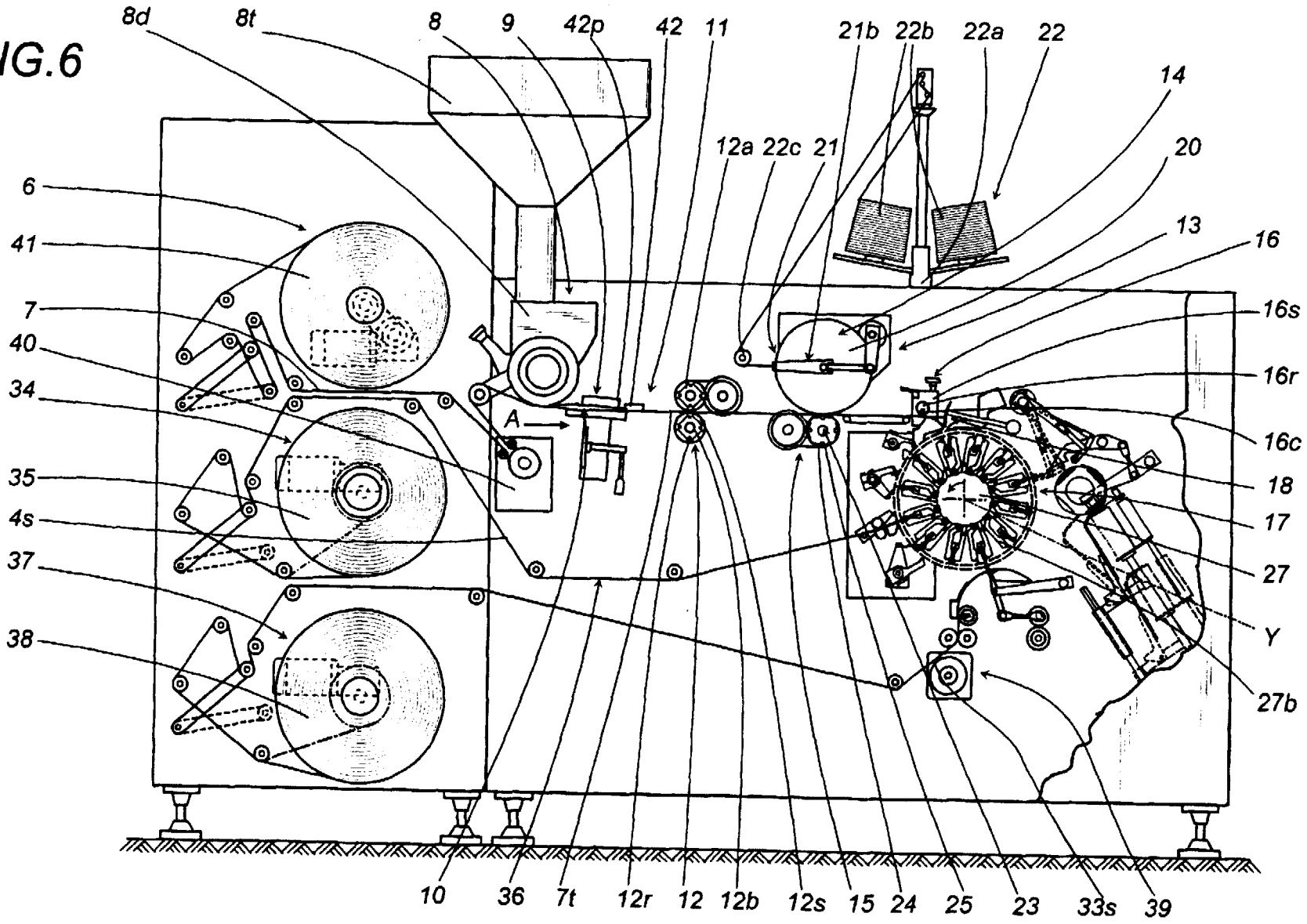
FIG. 6 is a schematic front view, with some parts cut away in order to better illustrate others, of the apparatus for making the tea bag illustrated in the above mentioned figures.

As is clearly shown in FIG. 6, the apparatus used to make tea bags of the kind just described essentially envisages a plurality of stations (preferably seven in number) located one after the other along a feed line A.

Figure 7:
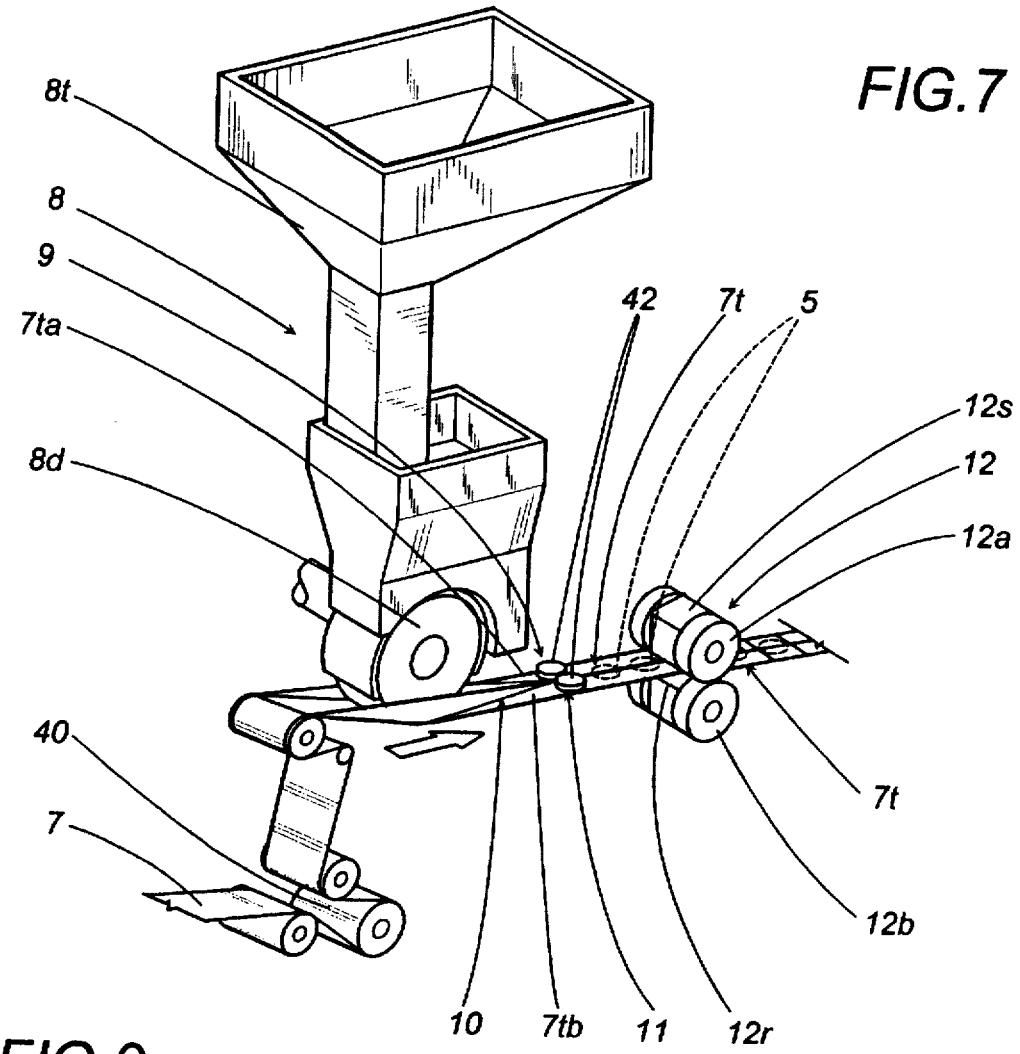
FIG. 7 is a schematic, perspective view, with some parts cut away in order to better illustrate others, of a part of the apparatus shown in FIG. 6, namely, a product feed station and a second station equipped with folding and sealing means.

The first station 6 feeds a continuous strip 7 of filter paper towards a product feed unit 8 (see also FIG. 7). The feed unit 8 (consisting of a hopper **8*t* and a doser 8*d*) places the product charges 5 at preset intervals on a defined area along the middle of the strip 7**.

The strip 7 is drawn continuously by a motor-driven unwinding roller 40 from a roll 41 located upstream of the unwinding roller in relation to the feed line A.

Downstream of the unit 8 that feeds the product charges 5, there is envisaged a second station 9 which comprises means 10 designed to fold the free lateral edges **7*ta* and 7*tb* of the strip 7 over the product charges 5 placed on the strip itself. This forms a continuous tube 7*t* of filter paper that is half as wide as the original strip and that has a longitudinal center line X (see also FIG. 5**).

As shown schematically in FIG. 7, the said folding means 10 may consist simply of a semicylindrical, horizontal guide (of known kind and therefore not illustrated in detail) located just after the product charge 5 feed unit 8 and operating in conjunction with a third station 11 which seals the strip 7 lengthwise. The third station 11 may consist of a pair of plates **42*p* (illustrated schematically in FIG. 6) placed on opposite sides of the guide which blow hot air onto the said free edges 7*ta* and 7*tb* of the strip 7. As the free edges 7*ta* and 7*tb* move forward, they pass through a pair of rollers 42, with vertical axes, placed side by side, which join the said free edges 7*ta* and 7*tb* together, thus forming a continuous sealed tube 7*t* with, along the middle of it, a seam line 7** parallel to the aforementioned center line X.

Still with reference to FIGS. 6 and 7, the next station, labeled 12, in the series of stations on the machine, is designed to seal the continuous tube **7*t* crossways in such a way as to close off each single product charge 5 at the front 7*a* and at the back 7*p* and to form individual pouches, each pair of which 1 and 2**, will be used to make a two-lobed tea bag.

The fourth station 12 consists of a pair of opposing, motor-driven rollers **12*a* and 12*b*, with recesses 12*s* made in them to accommodate the product charges 5 and on both sides of which there are heaters 12*r* designed to seal the aforementioned front and rear areas 7*a* and 7*p***.

Figure 5:
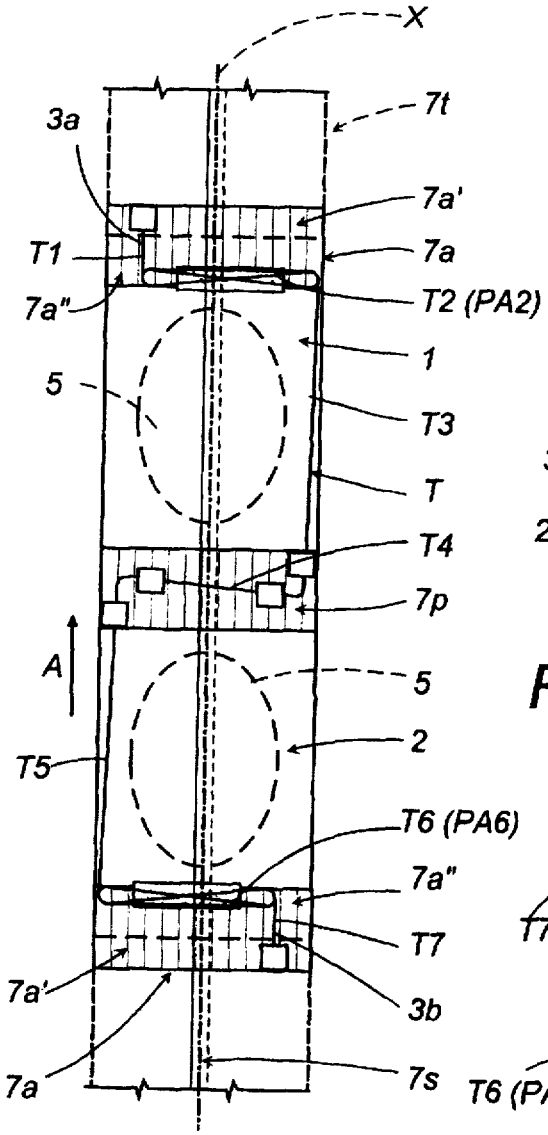
FIG. 5 illustrates a piece of tubular filter paper, during a stage in the production of the tea bag illustrated in the above mentioned figures using the apparatus disclosed by the present invention.

Downstream of the rollers **12*a* and 12*b*, there is a fifth station 13 equipped with means 14 for forming a path T followed by a heat-sealable thread 3, the path T being clearly visible in FIG. 5** and consisting of a consecutive series of sections T1, T2, T3, T4, T5, T6 and T7 arranged in a coil S.

The means 14, besides forming the path T, also permit the thread 3 to be placed on the free surface of the continuous tube **7*t* in such a way that the path T thus formed (meaning by path the said succession of sections T1 to T7) is placed on each pair of pouches 1 and 2. On each pair of pouches 1 and 2, the ends 3*a* and 3*b* of the thread 3 are laid on the corresponding front area 7*a* of each pouch 1 and 2** on opposite sides of the above mentioned center line X.

The means 14 that define the path followed by the thread 3 (which is unwound continuously) envisage a first roller 20 equipped with thread 3 positioning elements 21 and **21*b*. The first elements 21 can move along the surface of the first roller 20 so that they can go back under the surface of the roller 20 when the thread 3 is being laid down on the continuous tube 7*t*, whilst the second bar element 21*b* moves in the proximity of the said roller in order to guide the thread 3 around the first elements 21 and allow the thread 3 to wind its way along the sections T1, T2, T3, T4, T5, T6 and T7 making up the path T and to be laid in this form on the free surface of the pouches 1 and 2**.

Above the roller 20, there is a unit 22 which feeds the (heat-sealable, continuous) thread 3 to the said roller. The unit 22 consists essentially of a fixed frame **22*a* which mounts one or more reels 22*b* with a tension roller 22*c* acting on them in order to keep the thread 3 on the roller 20** at the right tension.

The fifth station 13 is also equipped with localized heating means 15 at the above mentioned front and rear closed areas **7*a* and 7*p* of each pouch 1 and 2 so as to attach the thread 3 to the pouch 1 and 2 securely at the localized front and rear areas 7*a* and 7*p***.

As can also be seen in FIG. 6, the said heating means 15 consist of a second motor-driven roller 23 located under the plane made by the continuous tube **7*t*** moving along the feed line A.

The second roller 23 is opposite the first roller 20 and has, on its lateral surface, a series of recesses 24 designed to accommodate the pouches 1 and 2 alternated with parts 25 equipped with heating elements designed to heat the front areas **7*a* and rear areas 7*p* of each pair of pouches 1 and 2 when the thread 3** is placed on the pouches.

The parts 25 of the second roller 23 are shaped in such way as to heat localized points of the front areas **7*a* and rear areas 7*p* of the pouches 1 and 2 and so that the thread 3 is sealed to the pair of pouches 1 and 2** at predetermined sealing points which define the sequence of sections T1, T2, T3, T4, T5, T6 and T7.

Two of the intermediate sections of thread thus formed, namely, the ones labeled T2 and T6, are at right angles to the center line X on corresponding front areas **7*a* of each pouch 1 and 2, forming corresponding points PA2 and PA6 where the thread 3 is temporarily accumulated and from which it can be detached from the said front areas. Each of these points PA2 and PA6 consists of a looped piece of thread 3 (see FIG. 5). Obviously, this configuration is defined by the means 14** described earlier.

Once the thread 3 has been laid on and sealed to the pouches 1 and 2, the tube **7*t* reaches a sixth station 16 which cuts it and the thread 3 crossways in such a way as to form a tea bag in a configuration that comprises the following: a pair of pouches 1 and 2 complete with a piece of thread 3 which is sealed to the said pouches at localized points on the front areas 7*a* and rear areas 7*p* and whose two ends 3*a* and 3*b* are placed on corresponding front areas 7*a* of each pouch 1 and 2 on opposite sides of the center line X (as clearly shown in FIG. 5**).

The sixth station 16 consists essentially of a rotary knife **16*c* fitted to a roller 16*r* mounted on a frame 16*s*** in such a way that it can rotate.

Downstream of the cutting station 16 there is a seventh station 17 equipped with folding means 18 and sealing means 26 to fold over and join the pouches 1 and 2 to each other at their free ends 1*b* and 2*b* defined by the corresponding front areas 7*a* of each pouch 1 and 2. In addition to the means 18 and 26, there are also envisaged means 19 designed to apply the tag 4 to the outermost parts 1*b*' and 2*b*' of the free ends 1*b* and 2*b* of the pouches 1 and 2 which include the above mentioned ends 3*a* and 3*b* of the thread 3.

Figure 8:
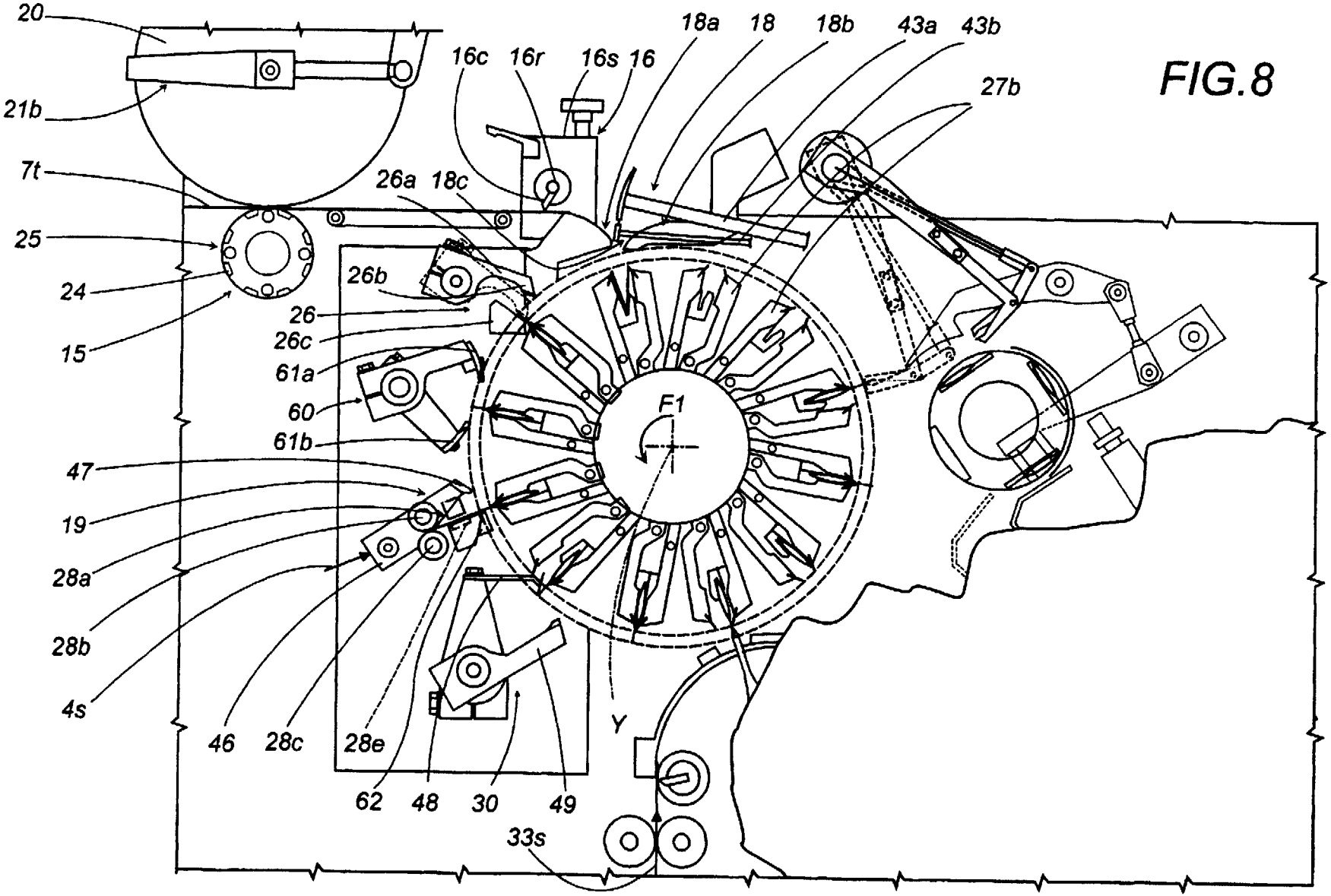
FIG. 8 is a schematic, front view, with some parts cut away in order to better illustrate others, of another part of the apparatus shown in FIG. 6, namely, a tea bag sealing and finishing station.

The seventh station 17, illustrated in detail in FIG. 8, consists of a carousel 27 that rotates about an axis Y and that is equipped with a plurality of grippers 27*b* each designed to hold a pair of pouches 1 and 2 and to carry the latter to each of a plurality of substations located around the carousel itself where different operations are carried out.

Figure 9:
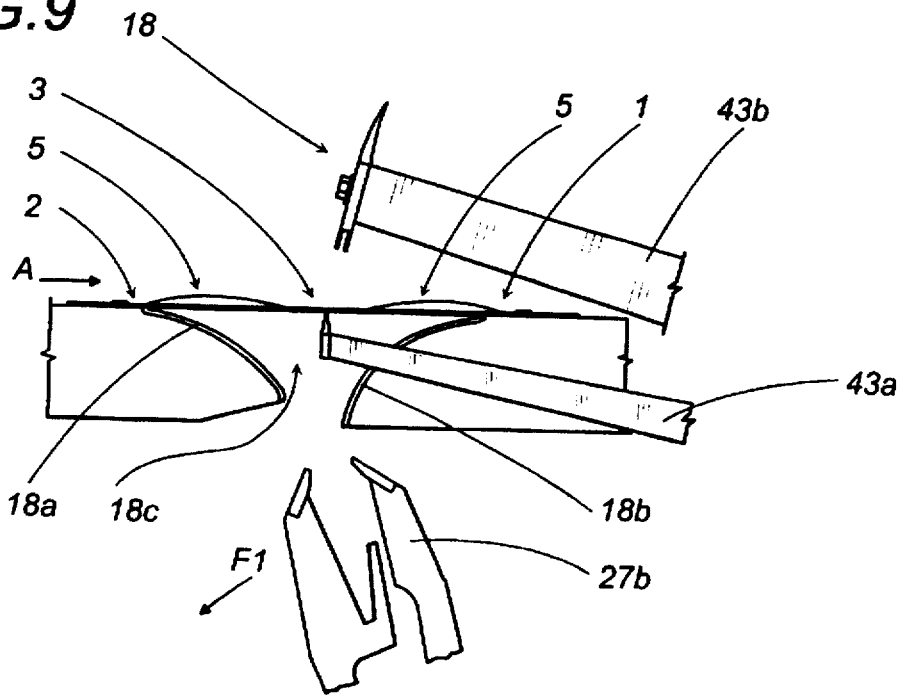
FIG. 9 is a scaled-up, schematic front view of a single folding substation of the station illustrated in FIG. 6.

The first of these substations, also illustrated in FIG. 9, has means 18 that fold the pouches 1 and 2 towards each other. The said means 18 consist of a pair of fixed guides 18*a* and 18*b* placed on both sides of a central recess 18*c* through which the tea bag is made to pass in a direction perpendicular to the feed line A.

This is done by a pair of levers 43*a* and 43*b* which pull and push the tea bag towards and away from the said recess 18*c* and are designed to pick up the said pair of pouches 1 and 2 and place them in one of the above mentioned grippers 27*b* folded in such a way that the two pouches 1 and 2 are face to face and with the thread 3 also attached to one of their surfaces. During the folding stage, the levers 43*a* and 43*b* also create, in known manner, thanks to their special shape (illustrated in FIG. 9) the typical concertina-like fold at the bottom ends 1*a* and 2*a* (shown in FIG. 1).

As the carousel 27 rotates (in the direction of the arrow F1 shown in FIGS. 8 and 9), the gripper 27*b* carries the tea bag to a second substation equipped with the above mentioned sealing means 26. The latter securely attach the two pouches 1 and 2 to each other at the innermost parts 1*b*" and 2*b*" of their free ends 1*b* and 2*b*, that is to say, the front areas 7*a*" that protrude from the gripper 27*b*.

The sealing means 26 consist of an arm 26*a*, pivoted at one end and mounting a sealing plate 26*b*, and a counterplate 26*c*. The sealing plate 26*b* is shaped in such a way as to create a broken join line L1 (see FIGS. 2 and 4) leaving gaps for the sections T1 and T7 of the thread 3 in the above mentioned front areas 7*a*.

The carousel 27 continues to turn to carry the individual grippers 27*b* to a third substation 60 where the free ends of the tea bags are prescored. The third substation comprises a pair of opposing knives 61*a* and 61*b* designed to prescore the free ends 1*b* and 2*b* of the pouches 1 and 2 in such a way as to create a second weakened line 31 extending crossways with respect to the longitudinal line X through the center of the pouches 1 and 2.

Next, the carousel 27 carries the tea bag to a fourth substation equipped with other sealing means 19 where the tag 4 is applied to the outermost parts 1*b*' and 2*b*', corresponding to the front areas 7*a*', of the free ends 1*b* and 2*b* of the pouches 1 and 2.

The fourth substation is connected to a first unit 34 (see also FIG. 6) that feeds a continuous strip of tags 4*s*. This feed unit 34 consists of a motor-driven roller 35 and first means 36 for conveying the said continuous strip to the said fourth substation.

Looking in more detail, there are means 19 which may consist of a scoring element 28*a* with a related counter-element 28*e* designed not only to cut off each single tag 4 but also to create a weakened line 29 through the center of the tag 4, before the tag 4 itself is applied to the pouches 1 and 2. The scoring elements 28*a* and 28*e* may be positioned after a pair of unwinding rollers 28*b* and 28*c* located upstream of the gripper 27*b* along the direction in which the strip 4*s* of tags 4 is fed. The cut-off and scoring elements 28*a* and 28*e* have alternating motion and are represented by a broken line in the drawings.

The means for creating the first weakened line 29 is not necessary on the apparatus if the continuous strip of tags 4 being used already has the said first weakened lines 29 made in it.

Between the gripper 27*b* and the scoring element 28*a* there is an arm 46 mounting at one end a sealing unit 47 used to apply the tag 4 to the joined ends 1*b*' and 2*b*' of the pouches 1 and 2. In order to correctly seal the tag 4, the latter is placed against a counterplate 62 which, as soon as sealing has been effected, also allows the tag 4 to be partially turned upwards (the upward turn being illustrated as a broken line in FIG. 8) as the carousel continues to rotate.

The latter rotating motion of the carousel carries each gripper 27*b* close to a fifth substation 30 where the tag 4 is folded and partially sealed to the tea bag. This substation comprises a pusher element 48, that acts on the surface of the tea bag on which the tag 4 is folded, and a sealing unit 49 acting on the opposite surface of the tea bag (both mounted on the same shaft but having independent drives).

The sealer unit 49 is shaped in such a way as to activate a part of the glue on a specific area of the tea bag so as to create a punctiform seal (or "weak" seal) firm enough to hold the tag 4 to the tea bag but such as to allow the user to detach the tag without tearing the tea bag.

Figure 1:
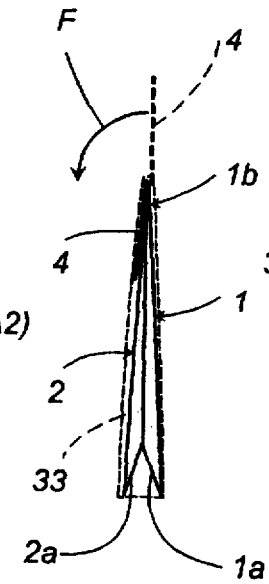
FIGS. 1 and 2 illustrate a tea bag for infusable products made by the apparatus disclosed by the present invention and shown, respectively, in a state prior to use, with overwrap, and in an intermediate, pre-infusion state, these two figures being a schematic side view and a front view, respectively.
Figure 2:
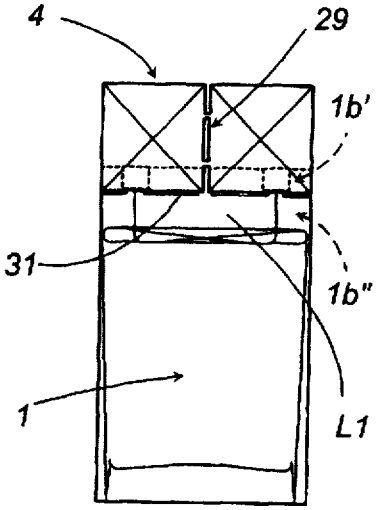
Figure 4:
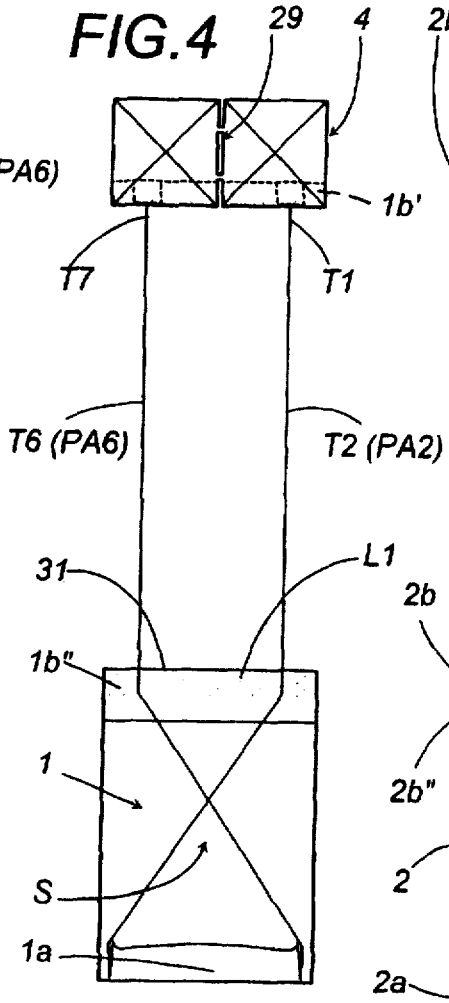
FIGS. 3 and 4 are a side view and a front view, respectively, of the tea bag shown in FIGS. 1 and 2 in the state it assumes during infusion.
Figure 3:
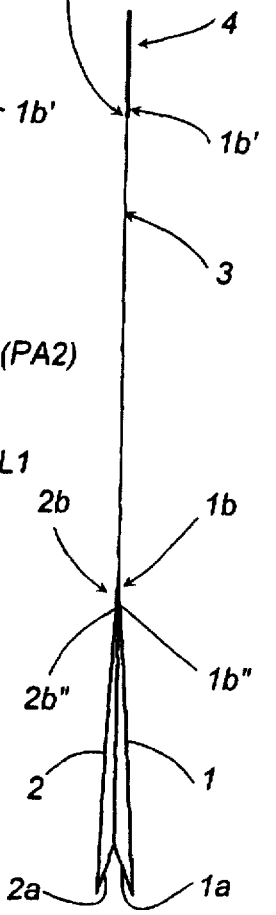

In this way, the tag 4 is folded over so it is flat against and sealed to the side of a related pouch 2 (the direction of rotation is indicated by the arrow F in FIG. 1).

The pouches 1 and 2 and the tag 4 folded in this way can then be wrapped with a suitable overwrap 33 shown with a broken line in FIG. 1).

The apparatus disclosed may also envisage a second unit 37 (see FIG. 6 again) for feeding a continuous strip of tea bag overwraps 33*s* with the tags 4 incorporated in them.

The second unit 37 consists of a second motor-driven roller 38 and second means 39 for conveying the continuous strip 33*s* to the seventh station 17.

The seventh station separates each overwrap 33 from the continuous strip by known means which are not fully illustrated and uses it to wrap up the tea bag.

After this wrapping operation, the finished tea bags are fed to customary cartoning stations (not illustrated) for final packaging operations.

The apparatus disclosed by the present invention therefore achieves the above mentioned aims by providing a fast and reliable automatic tea bag apparatus consisting of a plurality of synchronized and relatively small stations making up a comparatively compact machine.

Moreover, the said stations make a two-lobed tea bag with an intricate thread system to provide an effective means of squeezing and have a high output capability: this makes for a superior quality product at a relatively low cost, thus providing a tea bag that is extremely competitive on the market.

The invention described can be subject to modifications and variations without thereby departing from the scope of the inventive concept. Moreover, all the details of the invention may be substituted by technically equivalent elements.

What is claimed:

1. A packaging apparatus, for making tea bags for infusable products, each bag consisting of a tube of heat-sealable filter paper forming a pair of pouches, each containing a charge of infusable product; the said pouches being sealed all around them, attached to each other by corresponding ends and folded over so as to come face to face; there being attached between the facing surfaces of the pouches a thread with a tag designed to allow the tea bag to be manipulated during infusion and also squeezed by pulling the thread from the end of it with the tag on it; the said apparatus being characterized in that it comprises at least the following stations, located one after the other along a feed line:

a first station to feed a continuous strip of filter paper towards a feed unit which places the product charges at preset intervals on a defined area of the strip;

a second station comprising means designed to fold the free lateral edges of the strip over the product charges placed on the strip itself to form a continuous tube of filter paper that is approximately half as wide as the original strip and that has a longitudinal center line;

a third station which seals the continuous tube lengthwise at the said free lateral edges which have been folded over each other;

a fourth station designed to seal the continuous tube crossways in such a way as to close off each single product charge at the front and at the back and to form individual pairs of pouches;

a fifth station equipped with means designed to form a path followed by a heat-sealable thread, and consisting of a consecutive series of sections arranged in a coil and designed also to allow individual paths to be laid uninterruptedly on each pair of pouches with the free ends of the thread being laid on the corresponding front area of each pouch on opposite sides of the above mentioned center line; the said fifth station being equipped also with localized heating means at the above mentioned front and rear closed areas of each pouch so as to attach the thread to the pouch securely at the localized front and rear areas;

a sixth station to cut the tube and the thread crossways in such a way as to form a tea bag comprising a pair of pouches complete with a piece of thread which is sealed to the said pouches at localized points on the front and rear areas and whose two ends are placed on corresponding front areas of each pouch on opposite sides of the center line;

a seventh station equipped with means to fold over and join the pouches to each other at their free ends defined by the corresponding front areas of each pouch and equipped also with means designed to apply the tag to the free ends of the pouches which include the above mentioned ends of the thread.

2. The apparatus according to claim 1, wherein the said means for forming the path of the thread envisage a first roller equipped with thread positioning elements which can move along the surface of and near the said first roller so as to make the thread follow the path along the sections and designed also to lay the thread on the free surface of the pouches.

3. The apparatus according to claim 1 wherein there is a unit which feeds the heat-sealable, continuous thread 3 to the said means for forming the said path.

4. The apparatus according to claim 1 wherein the said heating means consist of a second motor-driven roller located under the plane made by the continuous tube moving along the feed line and placed opposite the said means for forming the said path; the said second roller having, on its lateral surface, a series of recesses designed to accommodate the pouches alternated with parts designed to heat the front areas and rear areas of each pouch when the thread is placed on the pouch.

5. The apparatus according to claim 4 wherein the said portions of the said second roller are shaped in such a way as to heat localized points of the front areas and rear areas of the pouches to define a sequence of sections and where at least two of the intermediate sections of the path are at right angles to the center line on corresponding front areas of each pouch, forming corresponding points where the thread is temporarily accumulated and from which it can be detached, each said point consisting of a looped piece of the thread.

6. The apparatus according to claim 1 wherein the said seventh station consists of a carousel that rotates about an axis and that is equipped with a plurality of grippers each designed to hold a pair of pouches and to carry the latter to each of a plurality of substations located around the carousel itself where different operations are carried out, the first substation having means that fold the pouches towards each other, and the second substation consisting of the said sealing means which are designed to securely attach the two pouches to each other at the innermost parts of their free ends or front areas and in such a way as to create a broken join line leaving gaps for the sections of the thread in the above mentioned front areas.

7. The apparatus according to claim 6 wherein the said seventh station has a third substation for prescoring the free ends of the corresponding pouches; the said third substation comprising a pair of opposing knives designed to prescore the free ends of the pouches in such a way as to create a second weakened line extending crossways with respect to the longitudinal line through the center of the pouches and in the proximity of the next line where the said tag is attached to the pouches themselves.

8. The apparatus according to claim 6 wherein the said seventh station has a fourth substation equipped with the said means which seal the tag to the outermost parts of the free ends of the pouches; the said means being made in such a manner as to create a first weakened line along a center line parallel to the center line of the tag, before the tag itself is applied to the pouches, and to allow the tag to be partially turned upwards when the carousel continues to turn after the tag has been sealed.

9. The apparatus according to claim 6 wherein the said seventh station has a fifth substation where the tag is folded and partially sealed to the tea bag; the said fifth substation comprising a pusher element that acts on the surface of one of the pouches on which the tag is folded and a sealing unit acting on the surface of the other pouch so as to create a punctiform seal holding the tag to the pouches folded in such a manner that it can be wrapped with a suitable overwrap.

10. The apparatus according to claim 1 wherein there is a first unit that feeds a continuous strip of tags consisting of a motor-driven roller and first means for conveying the said continuous strip to the said seventh station.

11. The apparatus according to claim 1 wherein there is a second unit that feeds a continuous strip of tea bag overwraps with the tags incorporated in them and consisting of a second motor-driven roller and second means for conveying the continuous strip to the seventh station.

* * * * *